US012004625B1

(12) United States Patent
He

(10) Patent No.: US 12,004,625 B1
(45) Date of Patent: Jun. 11, 2024

(54) HAIR REMOVAL DEVICE

(71) Applicant: Jingtao He, Shenzhen (CN)

(72) Inventor: Jingtao He, Shenzhen (CN)

(73) Assignee: Jingtao HE, Shenzhen (CN)

( * ) Notice: Subject to any disclaimer, the term of this patent is extended or adjusted under 35 U.S.C. 154(b) by 0 days.

(21) Appl. No.: 18/347,548

(22) Filed: Jul. 5, 2023

(30) Foreign Application Priority Data

Apr. 21, 2023 (CN) ..... 202310461983.8

(51) Int. Cl.
*A45D 26/00* (2006.01)

(52) U.S. Cl.
CPC ..... *A45D 26/0004* (2013.01)

(58) Field of Classification Search
CPC ..... A45D 26/0004; A45D 26/00; A45D 2200/1054; A61B 2017/00752; A61B 2017/00761; A61B 2017/00747; A61B 17/54; A61B 2017/320004; A61B 2017/320008; A61B 2017/320012; A61B 17/3201; A61B 2017/00734; B26B 21/22; B26B 21/54
See application file for complete search history.

(56) References Cited

U.S. PATENT DOCUMENTS

2004/0015139 A1* 1/2004 La Bianco ..... A61M 35/003 604/289
2007/0225732 A1* 9/2007 Cho ..... A61B 17/54 606/131
2009/0157094 A1* 6/2009 Yeshurun ..... A61B 17/54 606/131
2010/0125287 A1* 5/2010 Cole ..... A61B 17/32053 606/133
2014/0305458 A1* 10/2014 Brewer ..... A61B 17/54 132/200
2015/0201969 A1* 7/2015 Dugo ..... A61B 17/54 606/131
2016/0058659 A1* 3/2016 Angelov ..... A61B 17/54 601/73
2016/0166038 A1* 6/2016 Oguchi ..... A45D 26/0009 219/223
2016/0218552 A1* 7/2016 Jayaraj ..... H01M 50/296
2019/0216207 A1* 7/2019 Fan ..... A45D 44/00
2021/0186552 A1* 6/2021 Farrow ..... A61B 17/320068
2022/0330983 A1* 10/2022 Kearney ..... B26B 21/4012

FOREIGN PATENT DOCUMENTS

CN 206542894 U 10/2017
CN 217660113 U 10/2022
CN 217851121 U 11/2022

* cited by examiner

*Primary Examiner* — Darwin P Erezo
*Assistant Examiner* — Brigid K Byrd
(74) *Attorney, Agent, or Firm* — Nitin Kaushik

(57) ABSTRACT

The present disclosure belongs to the technical field of hair care, and particularly relates to a hair removal device. It comprises a shell and a hair removal component connected to at least one side of the shell, wherein a hair removal surface is arranged on the side of the hair removal component facing away from the shell, a plurality of pattern groups are arranged on the hair removal surface, the pattern groups comprise at least one main annular convex pattern, and the main annular convex pattern is used to remove hair and dead skin from the surface of skin by rubbing against the skin when the hair removal surface is in contact with the skin. The hair removal device is ingenious in structural design and convenient to operate.

16 Claims, 19 Drawing Sheets

HAIR REMOVAL DEVICE

CROSS-REFERENCE TO RELATED APPLICATIONS

The application claims priority to Chinese patent application No. 2023104619838, filed on Apr. 21, 2023, the entire contents of which are incorporated herein by reference.

TECHNICAL FIELD

The present disclosure relates to the technical field of hair care, in particular to a hair removal device.

BACKGROUND

With the continuous improvement of people's material life, more and more people begin to pay attention to beauty care, and hair removal is one of the common items in beauty care. Common body hair removal methods include laser hair removal and other medical care measures. However, these care procedures are costly, especially when a plurality of courses of treatment are required to completely remove body hair. As the most common quick hair removal device, the shaver or the razor can remove body hair from the root by one or more blades. However, it often causes scratches or other injuries to the skin. Moreover, frequent blade maintenance or replacement is necessary to ensure that it is sharp enough.

The Chinese patent with a publication number of CN203709482U discloses a hair removal device, which comprises a bracket and a glass pad; the bottom of the bracket is flat; the glass pad comprises atop surface, a bottom surface and a surrounding wall, wherein the top surface of the glass pad is adhered to the bottom of the bracket, and the bottom surface is a rough surface for removing hair from the surface of the human skin and realizing the effect of hair removal. The international patent with a publication number of WO2022231527A1 also discloses a crystal hair remover. Similar to the above-mentioned Chinese patent in structure, the patent adopts the method of rubbing and removing the hair on the surface of the human body by a rough surface on a glass pad. However, due to large friction between the rubbing structure and the skin in the process of actual use, the user will experience pain, and even suffer "strawberry" skin, red and swollen skin or scratches, resulting in a poor user experience.

Therefore, it is a problem that needs to be solved at present to develop a hair removal device which is easy to operate, is durable and good in hair removal effect, will not cause skin damage and can improve the user experience.

SUMMARY

For the above-mentioned problems in existing hair removal devices, the purpose of the present disclosure is to provide a hair removal device which is ingenious in structural design, convenient to operate and good in hair removal effect, will not cause skin damage and achieves a good experience of hair removal.

In order to solve the above-mentioned technical problems, the present disclosure is realized through the following technical solution:

A hair removal device comprising a shell and a hair removal component connected to at least one side of the shell, wherein a hair removal surface is arranged on the side of the hair removal component facing away from the shell, a plurality of pattern groups are arranged on the hair removal surface, the pattern groups comprise at least one main annular convex pattern, and the main annular convex pattern is used to remove hair and dead skin from the surface of skin by rubbing against the skin when the hair removal surface is in contact with the skin.

Preferably, the pattern groups comprise at least two main annular convex patterns with different inner diameters, wherein the main annular convex pattern with a relatively small inner diameter is located inside the main annular convex pattern with a relatively large inner diameter.

Preferably, all main annular convex patterns are in annular shape.

Preferably, a plurality of the main annular convex patterns in one pattern group are concentric rings.

Preferably, the edge of the end of the main annular convex pattern away from the hair removal surface is provided with a vertical surface structure, an inclined surface structure or a cambered surface structure.

Preferably, the cross section of the main annular convex pattern is in arc, square, trapezoidal or triangular shape.

Preferably, the height of the main annular convex pattern is 5-105 μm.

Preferably, the hair removal component is made of crystal or glass, and the hair removal surface is of a planar or cambered surface structure.

Preferably, the hair removal surface is smooth.

Preferably, a plurality of the pattern groups are arranged in an array on the hair removal surface.

Preferably, the hair removal surface is further provided with auxiliary annular convex patterns between adjacent pattern groups.

Preferably, the auxiliary annular convex patterns are in annular shape and 5-105 μm high.

Preferably, the peripheral shape of the shell is in arc or square shape, and the peripheral shape of the hair removal component is in arc or polygonal shape.

Preferably, the side of the shell away from the hair removal component is provided with an arc groove or an arc-shaped protrusion or a handle.

Preferably, one side of the shell is provided with a holding groove, and the hair removal component is embedded and connected in the holding groove.

Preferably, the edge of the end of the shell close to the hair removal component is provided with a chamfered right-angle or fillet-angle structure.

Preferably, a hollow cavity is formed in the shell, and a driving component for driving the hair removal component to rotate and a circuit board electrically connected with the driving component are arranged in the cavity; the circuit board is electrically connected with an energy storage component for power supply.

Preferably, the circuit board is electrically connected with a speed gear adjustment component for adjusting the driving component.

Preferably, the driving component comprises a servo motor, and the output shaft of the servo motor extends and penetrates the side of the shell close to the hair removal component and is securely connected with the hair removal component.

Preferably, a sealing component is connected between the output shaft of the servo motor and the shell.

Preferably, the driving component comprises a servo motor, the output shaft of the servo motor is in eccentric rotation connection with the hair removal component through an eccentric shaft, a limiting component is connected between the hair removal component and the shell, and the limiting component is used to ensure that the hair removal component moves along a preset track when the servo motor drives the hair removal component to rotate.

Preferably, a PV cell panel electrically connected to the circuit board is arranged on the outside of the shell, and the PV cell panel is used to absorb solar energy and store it in the energy storage component.

Preferably, the circuit board is electrically connected with a charging component, the charging component comprises a charging port, the charging port penetrates the shell, and the charging port is at least one of the MiniUSB interface, MicroUSB interface, Type-c interface or Lightning interface.

Preferably, the charging port is provided with a waterproof silicone plug.

Compared with the prior art, the present disclosure has the following beneficial effects:

The hair removal device of the present disclosure comprises a shell and a hair removal component connected to at least one side of the shell, wherein a hair removal surface is arranged on the side of the hair removal component facing away from the shell, a plurality of pattern groups are arranged on the hair removal surface, the pattern groups comprise at least one main annular convex pattern, and the main annular convex pattern is used to remove hair and dead skin from the surface of skin by rubbing against the skin when the hair removal surface is in contact with the skin. The hair removal device is ingenious in structural design and convenient to operate. When the hair removal surface comes into contact with skin, the main annular convex pattern touches the skin and rotates gently, and in the process of rotating and rubbing against the skin, the main annular convex pattern grabs hair and pulls out or rubs off hair on the surface of the skin and removes dead skin. Due to the annular structure of the main annular convex pattern, the adoption of the rotation and rubbing mode can reduce skin irritation, improve hair removal efficiency, remove hair from skin painlessly, and achieve the effect of smooth skin.

In the hair removal device of the present disclosure, the pattern groups comprise at least two main annular convex patterns with different inner diameters, wherein the main annular convex pattern with a relatively small inner diameter is located inside the main annular convex pattern with a relatively large inner diameter. The effect of hair removal can be further improved by providing at least two main annular convex patterns.

In the hair removal device of the present disclosure, all main annular convex patterns are concentric rings. When the hair removal device is used to rub clockwise or counterclockwise along the circular pattern, the effect of hair removal is more significant, and improved efficiency of hair removal, painless hair removal and avoidance of skin damage can be realized.

In the hair removal device of the present disclosure, a plurality of main annular convex patterns in one pattern group are concentric rings. When the hair removal device is used to rub clockwise or counterclockwise along the circular pattern, the effect of hair removal is more significant, and improved efficiency of hair removal, painless hair removal and avoidance of skin damage can be realized.

In the hair removal device of the present disclosure, the edge of the end of the main annular convex pattern away from the hair removal surface is provided with a vertical surface structure, an inclined surface structure or a cambered surface structure. The efficiency of hair removal and the experience of hair removal can be improved.

In the hair removal device of the present disclosure, the cross section of the main annular convex pattern is in arc, square, trapezoidal or triangular shape. When the cross section of the main annular convex pattern is in arc shape, the experience in the rubbing process can be improved, and painless hair removal can be realized; when the cross section of the main annular convex pattern is in square, trapezoidal or triangular shape, the contact between end of the main annular convex pattern and hair can be facilitated, and the effect of hair removal can be improved.

In the hair removal device of the present disclosure, the height of the main annular convex pattern is 5-105 μm, which can improve the efficiency and effect of hair removal and realize painless hair removal.

In the hair removal device of the present disclosure, the hair removal component is made mainly of glass or crystal, and the hair removal surface is of a planar or cambered surface structure and is processed by chemical etching or laser engraving, which can improve the durability and wear resistance of the rubbing component, make cleaning and corrosion and rust prevention easy and realize the effect of being more environmentally friendly and hygienic.

In the hair removal device of the present disclosure, the hair removal surface is smooth, which can realize painless hair removal.

In the hair removal device of the present disclosure, a plurality of the pattern groups are located on the hair removal surface and distributed in an array. When the hair removal device is used to rub regularly along the main annular convex pattern, hair can be evenly grabbed and removed, which can be beneficial to neat hair removal, improve the efficiency of hair removal and achieve painless hair removal, thereby further improving the experience of hair removal.

In the hair removal device of the present disclosure, the hair removal surface is further provided with auxiliary annular convex patterns between adjacent pattern groups, and the gap between adjacent pattern groups can be filled by auxiliary annular convex patterns, thereby further improving the rubbing efficiency.

In the hair removal device of the present disclosure, the auxiliary annular convex patterns are in annular shape and 5-105 μm high, which can improve the efficiency and effect of hair removal and realize painless hair removal, thereby improving the experience of hair removal.

In the hair removal device of the present disclosure, the peripheral shape of the shell is in arc or square shape, and the peripheral shape of the hair removal component is in arc or polygonal shape; with the arc or square shape suitable for holding and conforming to ergonomics, the device is beneficial for more comfortable holding by the palm during hair removal, thus improving the user's experience and making the hair removal device difficult to fall off.

In the hair removal device of the present disclosure, the side of the shell away from the hair removal component is provided with an arc groove or an arc-shaped protrusion or a handle. With the arc groove or arc-shaped protrusion or handle suitable for holding by fingers or palm and conforming to ergonomics, the device is beneficial for more comfortable holding by the palm during hair removal, thus improving the user's experience and making the hair removal device difficult to fall off.

In the hair removal device of the present disclosure, the shell is provided with a holding groove on one side, and the hair removal component is embedded and connected in the holding groove, which can avoid the displacement of the hair removal component relative to the shell after long-term use.

In the hair removal device of the present disclosure, the edge of the end of the shell close to the hair removal component is provided with a chamfered right-angle or fillet-angle structure, which can improve comfort in the hair removal process.

In the hair removal device of the present disclosure, a hollow cavity is formed inside the shell, and a driving component for driving the hair removal component to rotate and a circuit board electrically connected with the driving component are arranged inside the cavity; the circuit board is electrically connected with an energy storage component for power supply; the manual hair removal device can be further intelligent, and the user's rubbing experience and efficiency can be improved.

In the hair removal device of the present disclosure, the circuit board is electrically connected with a speed gear adjustment component for adjusting the driving component; the speed gear adjustment component is used to switch between different speeds, and different speeds can be suitable for different hair removal situations, thereby greatly improving the application scenario and the user experience.

In the hair removal device of the present disclosure, the driving component comprises a servo motor, and the output shaft of the servo motor extends and penetrates the side of the shell close to the hair removal component and is securely connected with the hair removal component. The servo motor is used to drive the hair removal component to rotate, which can ensure the stable operation of the hair removal component.

In the hair removal device of the present disclosure, a sealing component is connected between the output shaft of the servo motor and the shell. The sealing component can prevent liquids such as water from entering the shell to avoid the short circuit or corrosion of electronic components and prolong the service life of electronic components.

In the hair removal device of the present disclosure, the driving component comprises a servo motor, the output shaft of the servo motor is in eccentric rotation connection with the hair removal component through an eccentric shaft, a limiting component is connected between the hair removal component and the shell, and the limiting component is used to ensure that the hair removal component moves along a preset track when the servo motor drives the hair removal component to rotate. Through the eccentric shaft, the hair removal component moves and rubs along a preset track, which simulates the manual rubbing track, and can realize efficient and gentle hair removal.

In the hair removal device of the present disclosure, the outer side of the shell is provided with a PV cell panel electrically connected with the circuit board, and the PV cell panel is used for absorbing solar energy and storing energy in the energy storage component; the hair removal equipment of this product is designed with various charging modes, and charging with the PV cell panel is beneficial to energy saving.

In the hair removal device of the present disclosure, the circuit board is electrically connected with a charging component, the charging component comprises a charging port, and the charging port penetrates the shell and is at least one of the Mini USB interface, Micro USB interface, Type-c interface or Lightning interface; the charging port can be provided with a plurality of interfaces, which is beneficial to application in various charging environments and improves the user experience.

In the hair removal device of the present disclosure, the charging port is provided with a waterproof silicone plug, which can prevent liquids such as water from entering the shell to avoid the short circuit or corrosion of electronic components and prolong the service life of electronic components.

BRIEF DESCRIPTION OF DRAWINGS

In order to provide a clearer description of the embodiments of the present disclosure or the technical solutions in the prior art, a brief introduction will be given to the drawings required in the description of the embodiments or the prior art. It is evident that the drawings in the following description are only some embodiments of the present disclosure. For ordinary technicians in the field, other drawings can be obtained based on the structures shown in these drawings without any creative effort.

Figure 1:
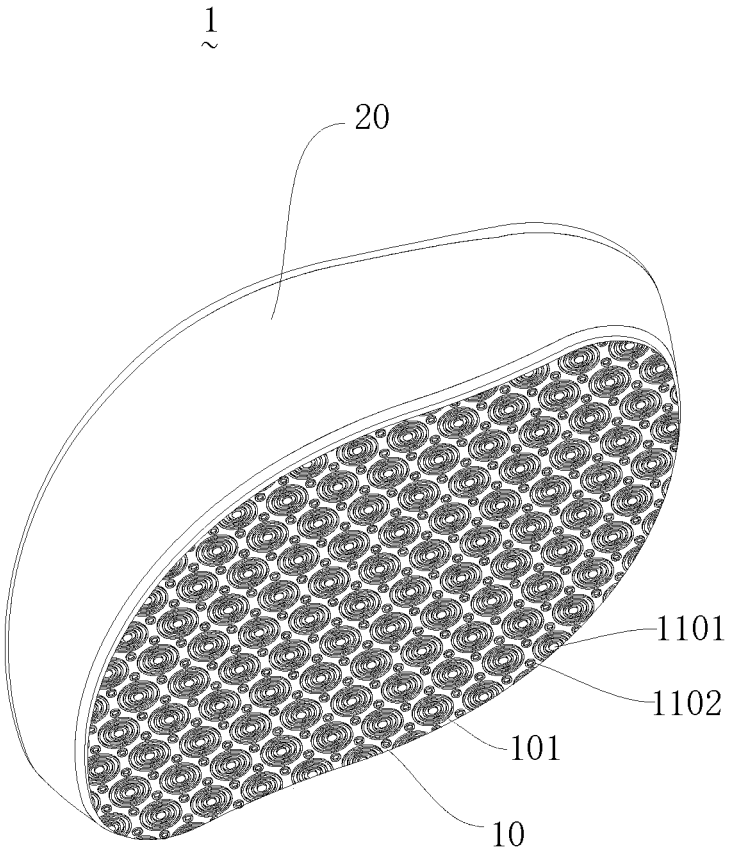
FIG. 1 is an overall structural diagram of the hair removal device in the embodiment of the present disclosure.

In the figures: 1 is the hair removal device, 10 is the hair removal component, 101 is the hair removal surface, 1101 is the pattern group, 1101*a* is the first main annular convex pattern, 1101*b* is the second main annular convex pattern, 1101*c* is the third main annular convex pattern, 1101*d* is the fourth main annular convex pattern, 1102 is the auxiliary annular convex pattern, 103 is the coaxial connector, 1031 is the fixed baseplate, 1032 is the shaft sleeve, 104 is the connecting sleeve, 1041 is the connecting cavity, 1041*a* is the first connecting cavity, 1041*b* is the second connecting cavity, 105 is the limiting ring, 20 is the shell, 2011 is the limiting column, 202 is the energy storage component, 2021 is the PV cell panel, 203 is the speed gear adjustment component, 204 is the back cover, 2041 is the arc groove, 2042 is the handle, 205 is the servo motor, 2051 is the output shaft, 2052 is the charging port, 206 is the speed gear adjustment button, 31 is the eccentric shaft, 311 is the shaft body, 312 is the second limiting part, 313 is the first limiting part, 32 is the threaded sleeve, 321 is the threaded rod, and 322 is the electromagnet.

DETAILED DESCRIPTION OF THE EMBODIMENTS

In order to make the above purposes, features and advantages of the application more obvious and understandable, a further detailed description of the application will be provided below based on the drawings and the embodiments.

In the description of the application, it should be understood that the orientation or positional relationship indicated by the terms "middle", "top", "bottom", "inside" and "outside" is based on the orientation or positional relationship shown in the drawings, which is only for the convenience of describing the application and simplifying the description, and does not indicate or imply that the device or element referred to must have a specific orientation and be constructed and operated in a specific orientation, so they cannot be understood as limitations on the application. The terms "first" and "second" are only used for descriptive purposes, and cannot be understood as indicating or implying relative importance or implicitly indicating the number of technical features indicated. Thus, features with limitations of "first" and "second" can explicitly or implicitly include one or more of these features. In the description of the application, "multiple" means two or more, unless otherwise clearly and specifically limited.

In addition, unless otherwise clearly specified and limited, the terms "installation", "connected", "connection" and "fixation" shall be understood in a broad sense, for example, it can be fixed connection, detachable connection or integrated connection; it can be mechanical connection or electric connection; it can be directly connected or indirectly connected through an intermediate medium; it can be the internal connection between two elements. For ordinary technicians in the field, the specific meanings of the above terms in the application can be understood based on specific circumstances.

In the application, unless otherwise clearly specified and limited, the first feature being "above" or "below" the second feature may include direct contact between the first and second features, and may also include indirect contact between the first and second features through other features between them. Moreover, the first feature being "above" the second feature includes the first feature being directly above and diagonally above the second feature, or simply means that the first feature is horizontally higher than the second feature. The first feature being "below" the second feature includes the first feature being directly below and diagonally below the second feature, or simply means that the first feature is horizontally lower than the second feature.

In one embodiment, referring to FIG. 1 to FIG. 19, the present disclosure provides a hair removal device 1 to mainly solve some problems of the existing hair removal device, such as complex operation, low safety performance during use, poor hair removal experience, unobvious hair removal effect, and lack of durability.

Figure 2:
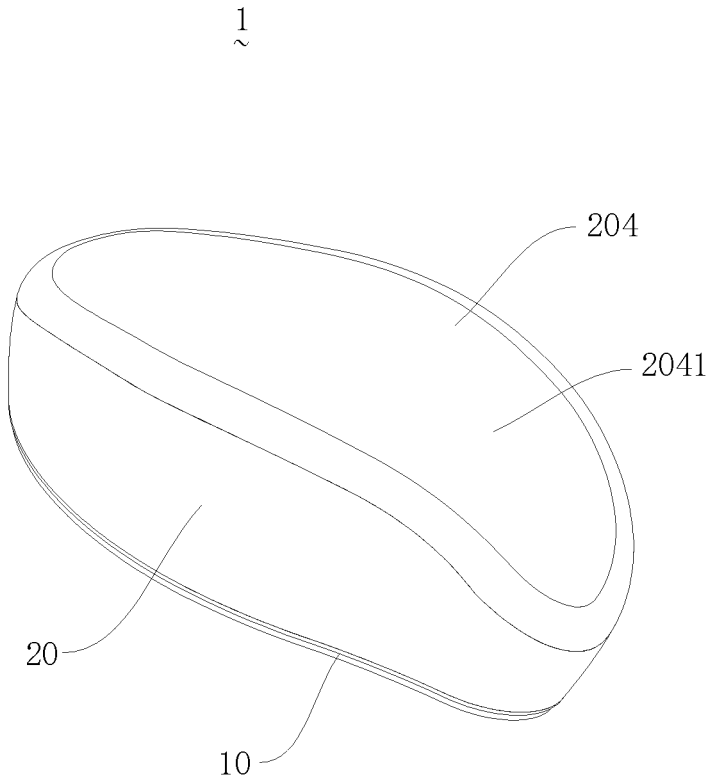
FIG. 2 is a structural diagram from another perspective of FIG. 1.
Figure 3:
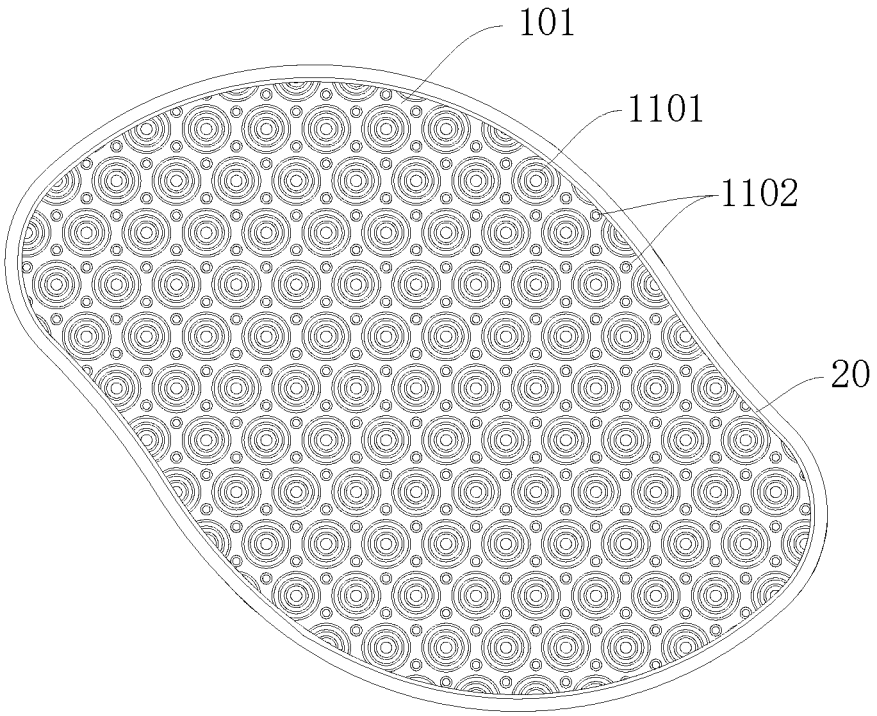
FIG. 3 is a structural diagram of the hair removal surface of the hair removal device in the embodiment of the present disclosure.

Referring to FIG. 1 to FIG. 3, the hair removal device 1 comprises a shell 20 and a hair removal component 10 connected to at least one side of the shell 20. The hair removal component 10 is provided with a hair removal surface 101 on the side facing away from the shell 20. The hair removal surface 101 is provided with several pattern groups 1101, which are used for rubbing against the skin when the hair removal component 10 comes into contact with the skin so as to grab and remove hair and dead skin on the skin surface. In the embodiment, the hair removal component 10 is a plane or cambered structure mainly made of crystal or glass, which is easy to use, easy to clean, anti-corrosion and anti-rust, and sanitary and environment friendly. Further, several pattern groups 1101 undergo chemical etching or laser engraving processes to future have durability properties without the need for regular replacement of the hair removal component 10.

In other embodiments, two or more sides of the shell 20 can be provided with the aforementioned hair removal component 10, which is not limited here.

The hair removal component 10 comprises the first side and the second side which are opposite, with the hair removal surface 101 being the first side. The pattern group 1101 is arranged on the first side, and the second side of the hair removal component 10 is connected with the shell 20. In a specific embodiment, the second side of the hair removal component 10 is fixedly connected with the shell 20. The pattern group 1101 is used for rubbing against the skin when the hair removal component 10 comes into contact with the skin so as to grab and remove the hair and dead skin on the skin surface.

In the embodiment, the pattern group 1101 is integrally formed with the hair removal surface 101. The pattern group 1101 comprises at least two main annular convex patterns with different inner diameters, wherein the main annular convex pattern with a relatively small inner diameter is located inside the main annular convex pattern with a relatively large inner diameter. In the embodiment, the number of main annular convex patterns is at least two, and multiple main annular convex patterns are mutually wrapped. Further, in one embodiment, at least two main annular convex patterns with different inner diameters are included, wherein the main annular convex pattern with a relatively small inner diameter is located inside the main annular convex pattern with a relatively large inner diameter. The pattern group 1101 is ingenious in structural design and convenient to operate; during use, the main annular convex pattern touches the skin and rotates gently, and in the process of rotating and rubbing against the skin, the hair on the skin surface is grabbed and rubbed off. Due to the annular structure of the main annular convex pattern, the adoption of the rotation and rubbing mode can reduce skin irritation, improve hair removal efficiency, and even painlessly remove hair and dead skin on the skin surface, thereby improving user experience. Certainly, the pattern group 1101 can also include only one main annular convex pattern, that is, the main annular convex pattern is distributed on the whole hair removal surface 101, which can also achieve the above-mentioned effects of hair removal and dead skin removal.

Figure 4:
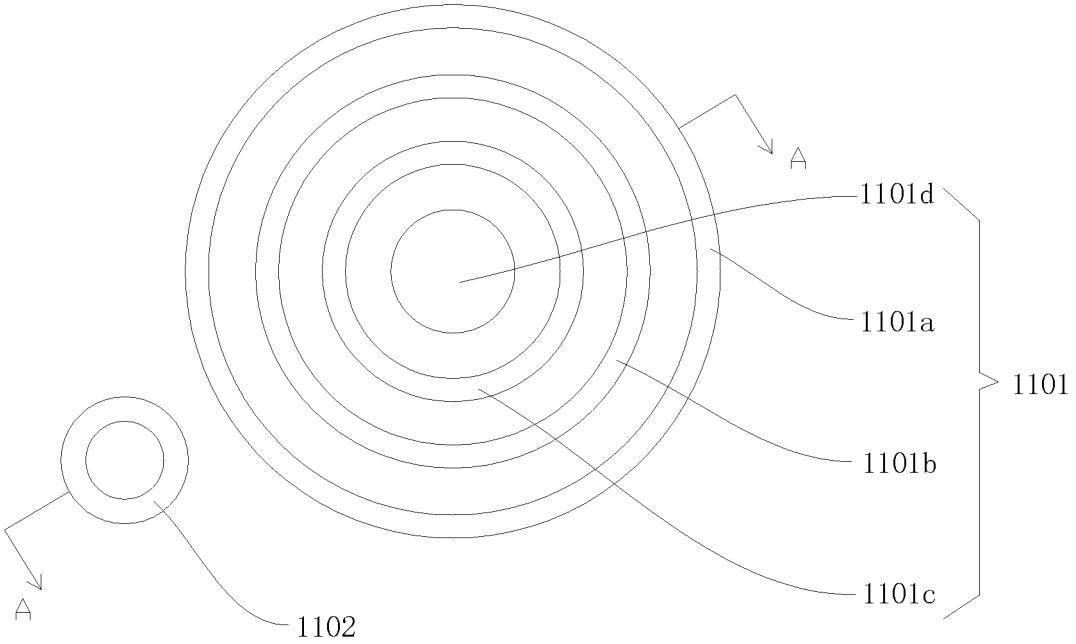
FIG. 4 is a structural diagram of the main annular convex pattern and the auxiliary annular convex pattern of the hair removal device in the embodiment of the present disclosure.

Further, in one embodiment, as shown in FIG. 4, in order to further ensure the hair removal experience during the use of the hair removal device, multiple main annular convex patterns in the present disclosure are all circular and have different inner diameters. When the hair removal device is used to rub and grab the hair clockwise or counterclockwise along the circular pattern, the hair removal effect is more significant, which can improve the efficiency of hair removal and achieve painless hair removal. Further, multiple main annular convex patterns in a single pattern group are concentric rings. When the hair removal device is used to rub clockwise or counterclockwise along the circular pattern, the hair removal effect is more significant, which can improve the efficiency of hair removal and achieve painless hair removal, thereby improving the hair removal experience. Further, the distances between adjacent rings are equal. Further, the diameter of the main annular convex pattern on the outermost ring can be selected to be no greater than 20 mm. In other embodiments, the single or multiple main annular convex patterns in the embodiment can also be replaced by the main annular convex patterns of the threaded structure.

Further, referring to FIG. 4, the pattern group 1101 comprises four main annular convex patterns with different inner diameters, and the main annular convex patterns with diameters from large to small are respectively the first main annular convex pattern 1101*a*, the second main annular convex pattern 1101*b*, the third main annular convex pattern 1101*c*, and the fourth main annular convex pattern 1101*d*; the first main annular convex pattern 1101*a*, the second main annular convex pattern 1101*b*, the third main annular convex pattern 1101*c*, and the fourth main annular convex pattern 1101*d* are concentrically arranged.

Further, referring to FIG. 3 and FIG. 4, the hair removal surface 101 is also provided with the auxiliary annular convex pattern 1102 between adjacent pattern groups 1101, and the gap between adjacent pattern groups 1101 can be filled by the auxiliary annular convex pattern 1102 to further improve the rubbing efficiency. In a specific embodiment, the auxiliary annular convex pattern 1102 is a circular ring, and the height of the auxiliary annular convex pattern 1102 is 5 μm-105 μm, for example, 50 μm can be selected. In the range, for long hair, the hair removal efficiency and effect are the best, and painless hair removal is achieved to improve the hair removal experience. In the embodiment, several auxiliary annular convex patterns 1102 are distributed in an array among several main annular convex patterns.

Figure 5:
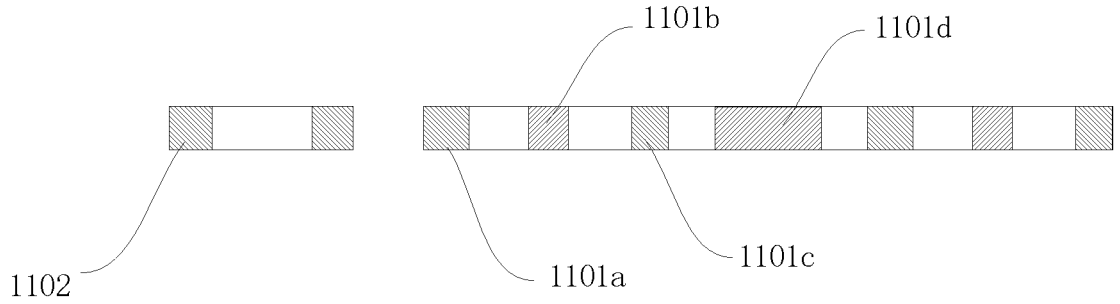
FIG. 5 is a sectional view along the A-A direction in FIG. 4.

In a specific embodiment, as shown in FIG. 5, the cross-section of any main circular convex pattern is of square structure, and the edge of the main circular convex pattern at one end far from the hair removal surface 101 can come into contact with the root of the hair, thereby improving the hair removal efficiency in the process of rotating and rubbing.

Figure 6:
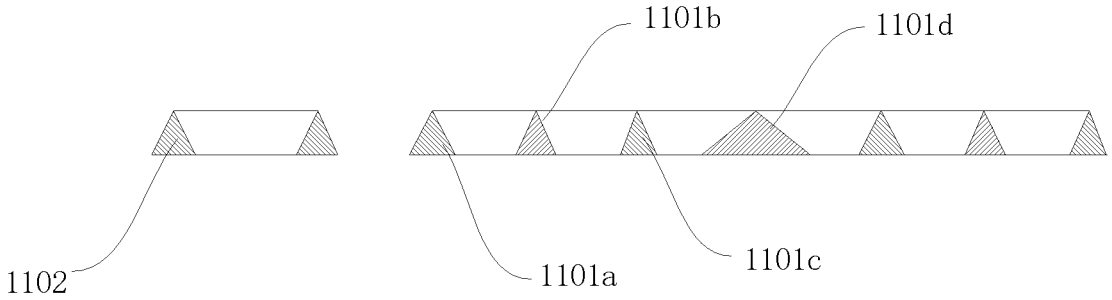
FIG. 6 is a sectional view along the A-A direction in another embodiment of FIG. 4.
Figure 7:
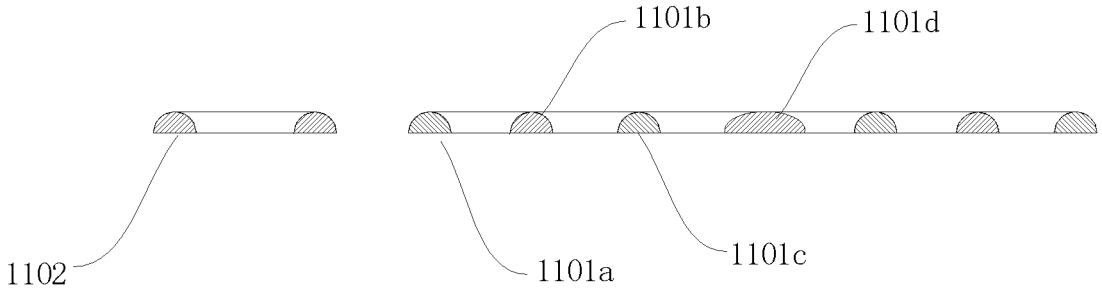
FIG. 7 is a sectional view along the A-A direction in another embodiment of FIG. 4.

In another specific embodiment, as shown in FIG. 6, the cross-section of any main circular convex pattern is of triangular structure. The edge of the main circular convex pattern at one end far from the hair removal surface 101 can come into contact with the root of the hair, thereby improving the hair removal efficiency in the process of rotating and rubbing.

In another specific embodiment, as shown in FIG. 6, the edge of the main circular convex pattern at one end far from the hair removal surface 101 is provided with an inclined structure or a cambered structure, and of course, it can also be provided with a straight structure. The main annular convex patterns in different pattern groups on the hair removal surface 101 are of different structures, which improves the hair removal efficiency and further improves the hair removal experience. When the cross-section of the main circular convex pattern is a smooth arc, the experience in the rubbing process can be improved, and skin abrasions can be effectively avoided. Further, the edges of the main circular convex patterns at one end far from the hair removal surface 101 in different pattern groups can be of different structures.

Of course, in other embodiments, the cross-sections of the main annular convex patterns can also be of other polygonal structures, which is not specifically limited here.

Specifically, the height of the main circular convex pattern is 5 μm-105 μm. Different heights of main circular convex patterns can be set based on different hair lengths and positions. In a specific embodiment, it is preferred to set the height as 50 μm. Due to the fact that the edges of the main circular convex patterns are burr free and do not cause scratches on the skin, hair removal efficiency and effect can be improved without affecting the user's hair removal experience, and painless hair removal can be achieved.

Specifically, the first side, namely the hair removal surface 101, is a smooth surface, and the second side can be a smooth or rough surface, which is not specifically limited here. In the rubbing process, compared with the fact that the hair removal surface 101 in the prior art is a rough surface, the hair removal surface 101 in the embodiment is a smooth surface. At the same time, the surfaces of the main circular convex pattern and the auxiliary circular convex pattern 1102 can be smooth surfaces, which can greatly improve the user experience during hair removal and avoid skin injury during hair removal.

Specifically, several pattern groups 1101 are distributed in an array on the hair removal surface 101. In the embodiment, several pattern groups 1101 are integrally arranged on the smooth hair removal surface 101 and are distributed in an array on the hair removal surface 101. When these circles rotate and rub regularly in the clockwise or counterclockwise direction, hair can be uniformly grabbed and removed, which is beneficial to orderly hair removal and can also achieve the effect of painless and rapid hair removal. In the embodiment, several pattern groups 1101 undergo chemical etching or laser engraving processes to have durability properties.

Specifically, the peripheral shape of the shell 20 is an arc shape or a square shape, and the hair removal component 10 is arc-shaped or is of polygonal structure. In the embodiment, the peripheral shape of the shell 20 is preferably an arc shape, which can avoid damaging the skin in the process of rubbing off hair; further, the width at both ends of the hair removal component 10 is smaller than the width in the middle, so that the two ends of the hair removal component 10 can be used to rub off the hair at special positions on the body surface. The shell 20 can also be of mango-shaped structure, which is suitable for holding and meets the requirements of human engineering mechanics. When the device is used to rub off hair, it is beneficial for the palm to hold it more comfortably, which improves the user experience and makes the hair removal device not easy to fall off.

However, in the embodiment, the shape of the shell 20 is not limited to this. It can be understood that the shape of the shell 20 includes but is not limited to a semicircle, a rhombus, a diamond shape, a water drop shape, an ellipse, a heart shape, a triangle shape, a cat-paw shape, a shell shape, a cashew shape, an apple shape, a rectangle shape and a column shape. The above-mentioned shapes are suitable for holding and meet the requirements of human engineering mechanics. When the device is used to rub off hair, it is beneficial for the palm to hold it more comfortably, which improves the user experience and makes the hair removal device not easy to fall off.

Figure 11:
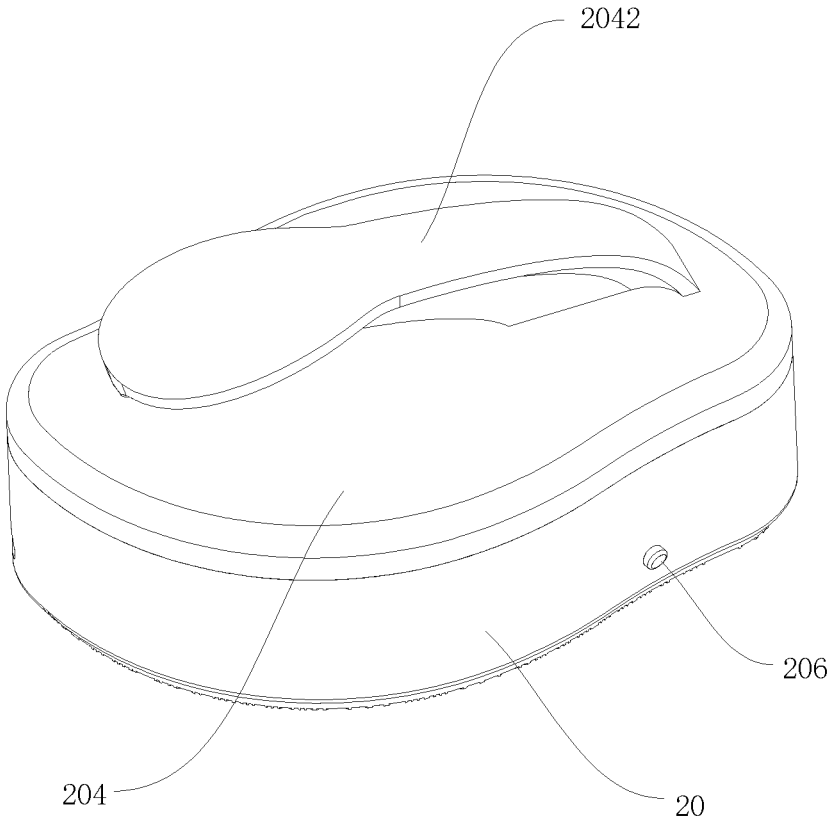
FIG. 11 is a structural diagram of the hair removal device in another embodiment of the present disclosure.
Figure 12:
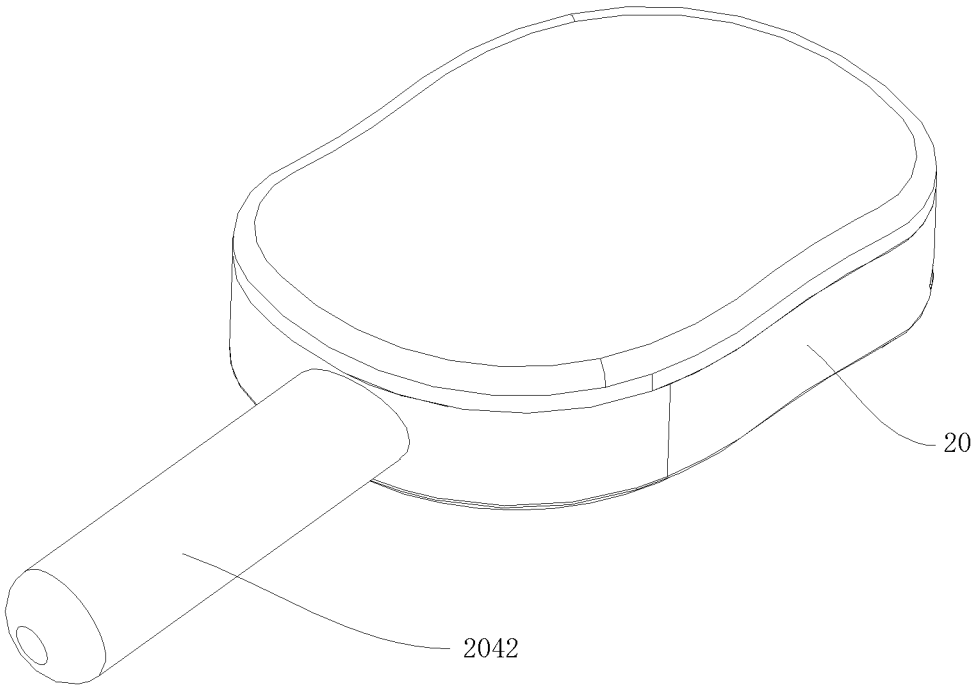
FIG. 12 is a structural diagram of the hair removal device in another embodiment of the present disclosure.

Further, in one embodiment, for example as shown in FIG. 2 and FIG. 11, the side of the shell 20 away from the hair removal component 10 is provided with an arc groove 2041 or an arc-shaped protrusion or a handle 2042. The arc groove 2041 or the arc-shaped protrusion or the handle 2042 is suitable for holding by fingers or palms and meets the requirements of human engineering mechanics. When the device is used to rub off hair, the holding by palms is more comfortable, the rubbing force is more uniform, and the hair removal device is not easy to fall off, thus improving the user experience. In other embodiments, as shown in FIG. 12, the handle 2042 can also be arranged at one end of the shell 20 so as to be convenient for the user to hold it for use.

Further, the shell 20 is provided with a holding groove on one side, and the hair removal component 10 is embedded in the connected holding groove, which can avoid the displacement of the hair removal component 10 relative to the shell 20 after long-term use. In the embodiment, the second side of the hair removal component 10 is connected in the holding groove. Further, in one embodiment, the connection mode can be glue bonding, double-sided adhesive tape bonding, buckle connection or screw connection, etc., and the connection mode of fixed connection is not limited here.

Further, the edge of the shell 20 near one end of the hair removal component 10 is provided with a chamfered right-angle or fillet-angle structure, which improves the comfort in the hair removal process. In the embodiment, the shape of the hair removal component 10 may or may not correspond to the shape of the shell 20. In the process of hair removal, the edge of the shell 20 near one end of the hair removal component 10 first contacts the skin. In order to improve the fit between the hair removal component 10 and the skin and avoid the corners of the shell 20 from hurting the skin, the periphery of the shell 20 is provided with a chamfered right-angle or fillet-angle structure, preferably chamfered fillet-angle structure.

Figure 8:
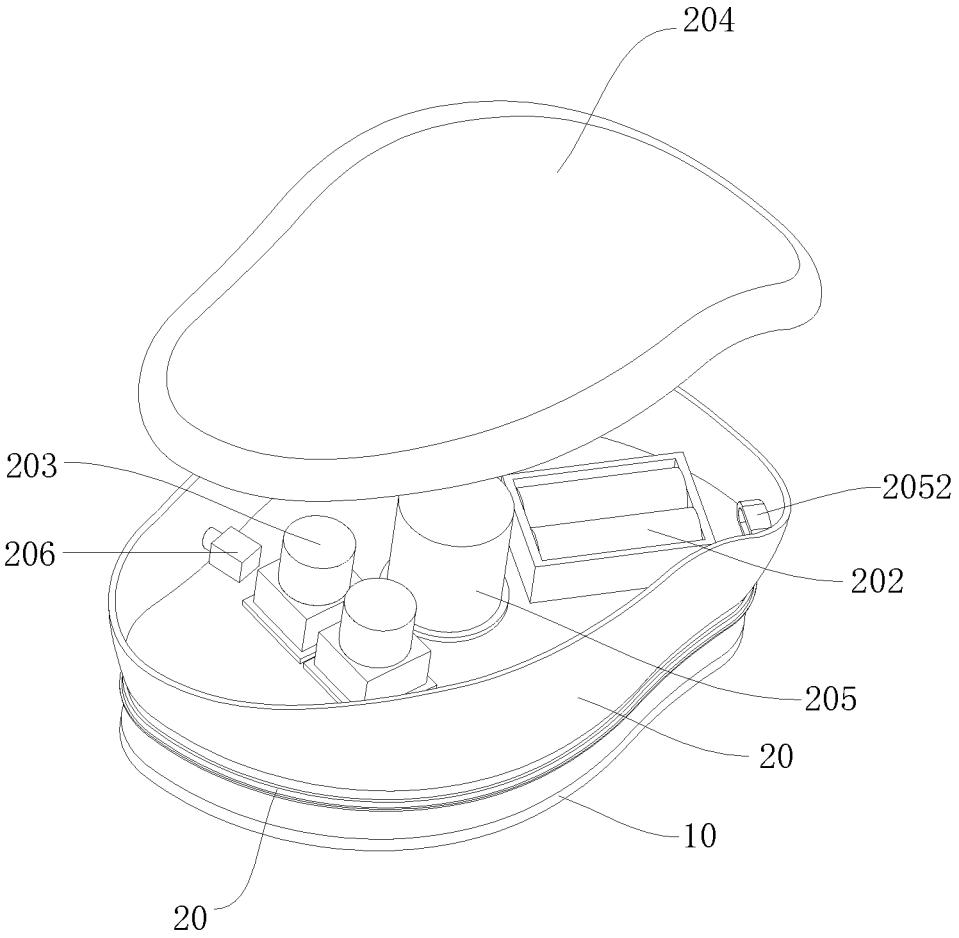
FIG. 8 is an exploded view of the hair removal device in another embodiment of the present disclosure.
Figure 9:
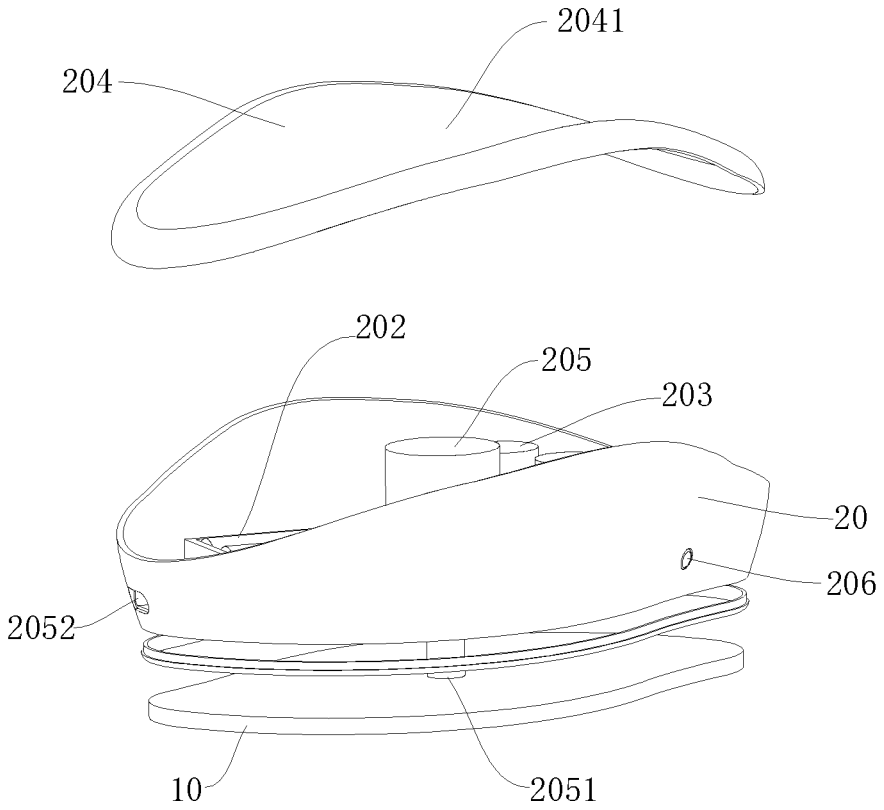
FIG. 9 is an exploded view from another perspective in FIG. 8.

Specifically, as shown in FIG. 8 and FIG. 9, a hollow cavity is formed inside the shell 20, and a driving component for driving the hair removal component 10 to rotate and a circuit board electrically connected with the driving component are provided and fixed inside the cavity; the circuit board is electrically connected with an energy storage component 202 for power supply; compared with manual hair removal, the use of a driving component to drive the hair removal component 10 to rotate can improve the convenience of hair removal to a certain extent and make the hair removal process easier and more intelligent. Further, the shell 20 includes a detachable back cover 204. By opening the back cover 204, the cavity can be opened, so as to facilitate the maintenance or replacement of circuit elements in the cavity. The back cover 204 can also be used to seal the cavity.

Figure 13:
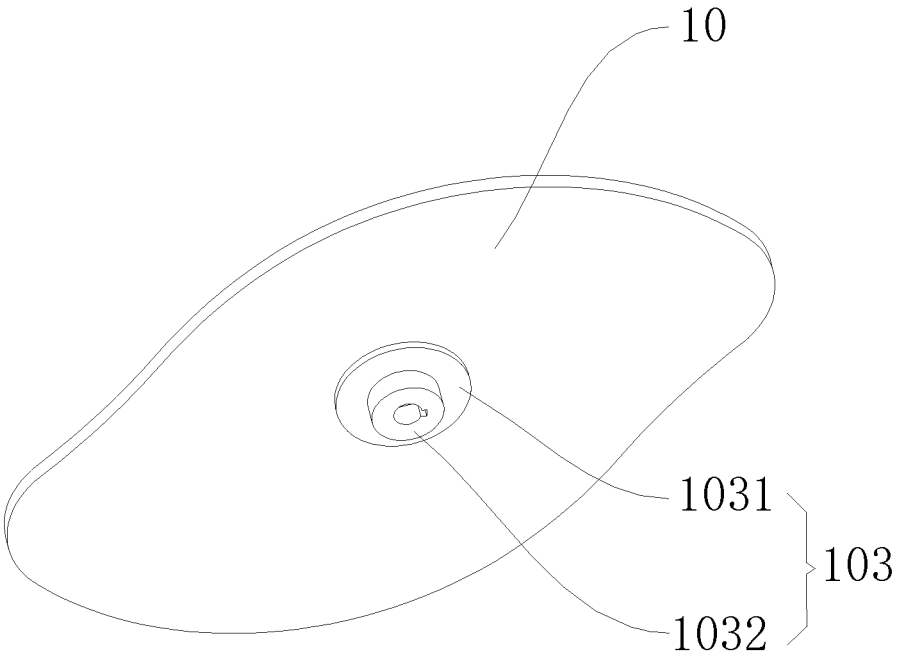
FIG. 13 is a structural diagram of the hair removal component of the hair removal device in another embodiment of the present disclosure.
Figure 14:
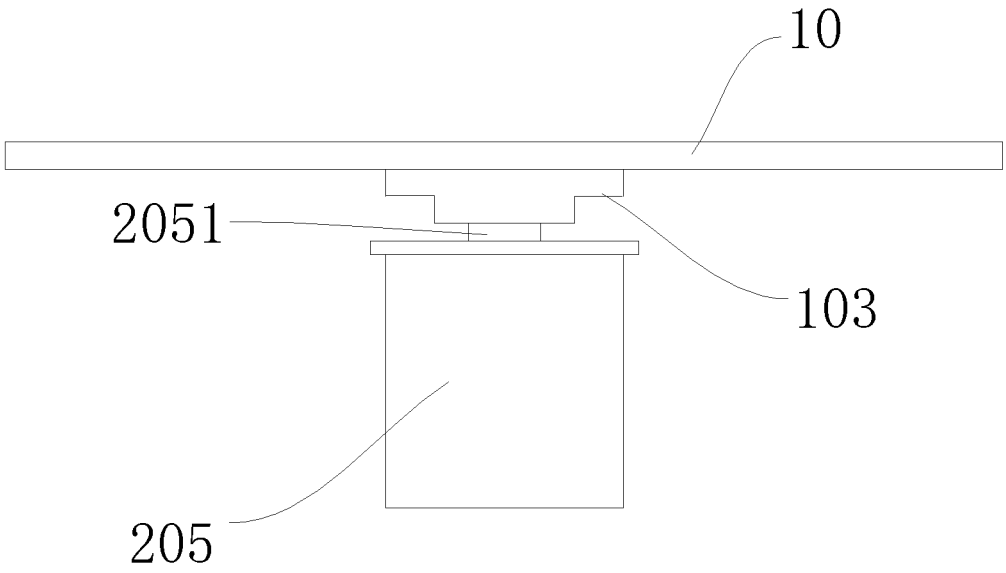
FIG. 14 is a structural schematic diagram of the connection between the hair removal component and the driving component of the hair removal device in another embodiment of the present disclosure.
Figure 15:
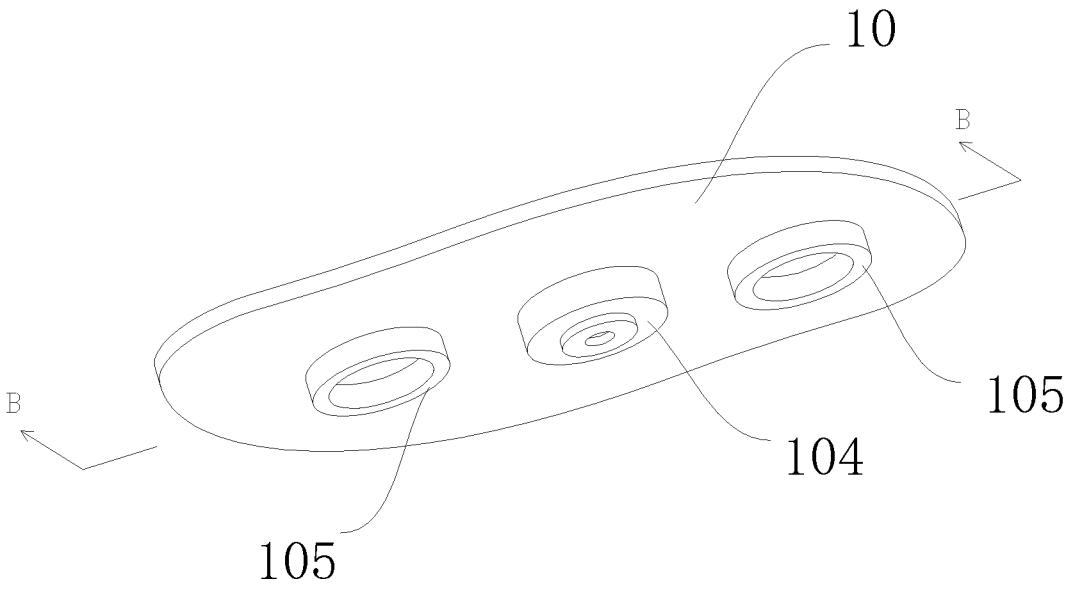
FIG. 15 is a structural diagram of the hair removal component of the hair removal device in another embodiment of the present disclosure.
Figure 16:
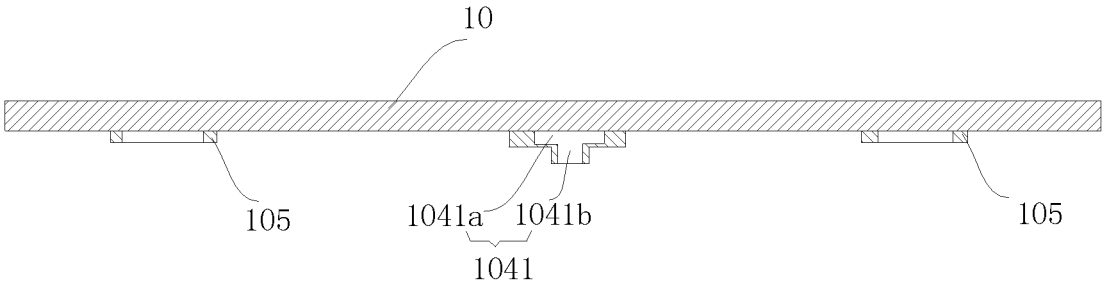
FIG. 16 is a sectional view along the B-B direction in FIG. 14.
Figure 17:
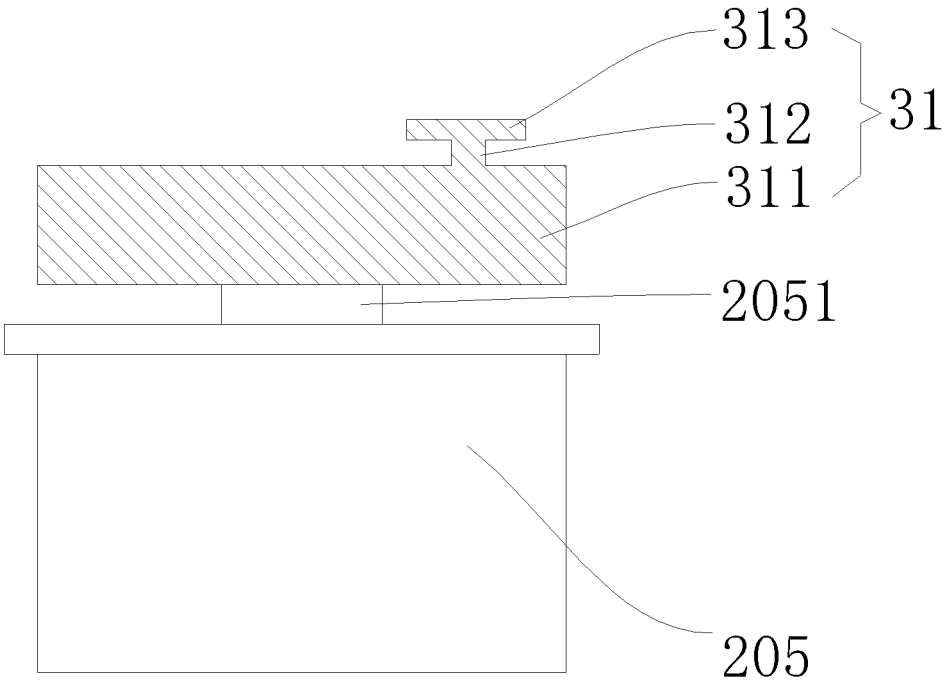
FIG. 17 is a structural schematic diagram of the driving component of the hair removal device in another embodiment of the present disclosure.
Figure 18:
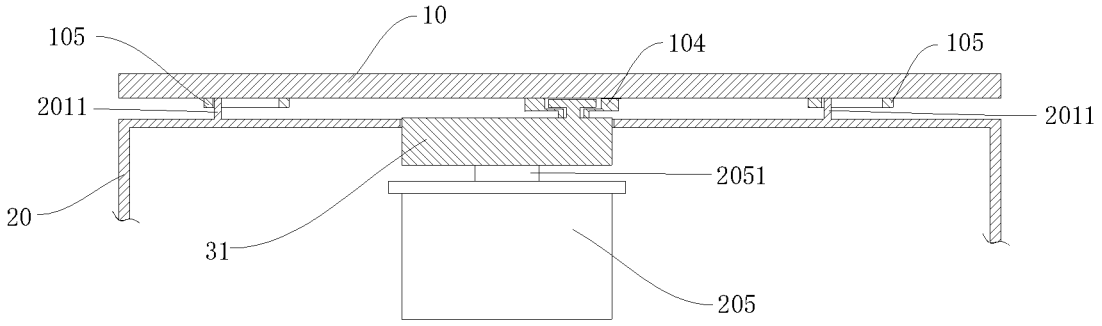
FIG. 18 is a structural schematic diagram of the connection between the hair removal component and the driving component of the hair removal device in another embodiment of the present disclosure.
Figure 19:
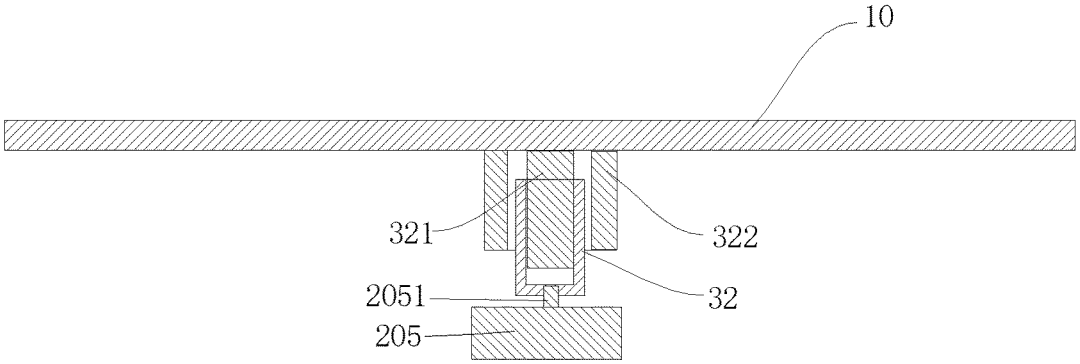
FIG. 19 is a structural schematic diagram of the connection between the hair removal component and the driving component of the hair removal device in another embodiment of the present disclosure.

In a specific embodiment, referring to FIG. 13 and FIG. 14, the driving component includes a servo motor 205, and the output shaft 2051 of the servo motor 205 extends and runs through the side of the shell 20 near the hair removal component 10, and is fixedly connected with the hair removal component 10. The servo motor 205 is used to drive the hair removal component 10 to rotate, which can ensure the stable operation of the hair removal component 10. The second side of the hair removal component 10 is fixedly connected with a coaxial connector 103, and the coaxial connector 103 comprises a fixed baseplate 1031 and a shaft sleeve 1032 that are integrally connected. The fixed baseplate 1031 is fixedly connected with the second side of the hair removal component 10 away from the shaft sleeve 1032. In the embodiment, it is preferably connected to the central position of the hair removal component 10 so as to ensure stable rotation of the hair removal component 10. At the same time, in the embodiment, the shaft sleeve 1032 can be connected with the output shaft 2051 of the servo motor 205, and the hair removal component 10 can rotate with the output shaft 2051 as the axis. The fixed baseplate 1031 can be used to increase the contact area between the shaft sleeve 1032 and the hair removal component 10, which can further ensure the stable rotation of the hair removal component 10 in the horizontal direction and avoid the hair removal component 10 from tilting towards a certain side in the process of pressing and rubbing off hair on the skin surface, which will affect the hair removal effect. By using the driving component, the manual hair removal device can be further intellectualized, the workload of manual hair removal by users can be reduced, and the user's rubbing experience and rubbing efficiency can be improved.

In another specific embodiment, referring to FIG. 15, FIG. 16, FIG. 17 and FIG. 18, the driving component includes a servo motor 205. The output shaft 2051 of the servo motor 205 is connected with the hair removal component 10 through the eccentric rotation of the eccentric shaft 31. A limiting component is connected between the hair removal component 10 and the shell 20. The limiting component is used to ensure that the hair removal component 10 moves along a preset trajectory when the servo motor 205 drives the hair removal component 10 to rotate. In the embodiment, the preset trajectory is a circular trajectory. Through the eccentric shaft 31, the hair removal component 10 moves along a preset trajectory for rubbing, which simulates the manual rubbing trajectory, so that efficient and gentle hair removal can be realized. Compared with the previous embodiment, in the embodiment, an eccentric shaft 31 and a limiting component are added between the output shaft 2051 of the motor and the fixed baseplate 1031, which simulates the process of manually rotating and rubbing off hair and can further improve the effect of rubbing off hair.

Specifically, the eccentric shaft 31 comprises a columnar shaft body 311 and a T-shaped connector integrally connected to the eccentric position of the shaft body 311. The connector comprises a first limiting part 313 and a second limiting part 312 that are integrally connected. The second side of the hair removal component 10 is connected with a connecting sleeve 104 which is connected with the connector in a clearance fit manner, and a T-shaped connecting cavity 1041 corresponding to the shape of the connector is arranged in the connecting sleeve 104. The connecting cavity 1041 comprises a first connecting cavity 1041*a* and a second connecting cavity 1041*b* which are connected, and the connector is fitted in the connecting cavity 1041. Specifically, the first limiting part 313 is clearance fitted in the first connecting cavity 1041*a*, and the second limiting part 312 is clearance fitted in the second connecting cavity 1041*b*. When the output shaft 2051 of the servo motor 205 drives the connector on the eccentric shaft 31 to make a circular motion, the connector can synchronously drive the hair removal component 10 to move along a preset trajectory. In the embodiment, since the movement trajectory of the connector is circular, the movement trajectory of the hair removal component 10 is also circular; moreover, since the connector is clearance fitted in the connecting sleeve 104, the hair removal component 10 itself will not rotate circumferentially along the center.

In order to avoid the loosening of the hair removal component 10 caused by the clearance fit of the connector inside the connecting sleeve 104, in the embodiment, a limiting component is also connected between the second side of the hair removal component 10 and the shell 20, and the limiting component is used to ensure that the hair removal component 10 moves along a preset trajectory when the servo motor 205 drives the hair removal component 10 to rotate. The limiting component comprises a limiting ring 105 connected to the second side of the hair removal component 10 and a limiting column 2011 connected to the shell 20. The diameter of the limiting ring 105 is the diameter of the movement trajectory of the connector, and the limiting column 2011 is fitted to the inner wall of the limiting ring 105. When the hair removal component 10 rotates synchronously with the connector, the limiting column 2011 rotates along the inner wall of the limiting ring 105, thus effectively limiting the shaking or loosening of the hair removal component 10. Further, the number of limiting components can be two or more, preferably two in the embodiment. The limiting ring 105 can be arranged on the hair removal component 10 or the shell 20, and the corresponding limiting column 2011 can be arranged on the shell 20 or the hair removal component 10, which is not limited here.

In order to avoid the loosening of the hair removal component 10 caused by the clearance fit of the connector inside the connecting sleeve 104, in another specific embodiment, the second limiting part 312 is connected in the second connecting cavity 1041*b* through a bearing fit. In other embodiments, referring to FIG. 14, the second side of the hair removal component 10 is provided with a hollow shaft sleeve 1032, and the connector and the connecting cavity 1041 are of columnar structure instead of the above-mentioned T-shaped structure. The connector can be directly connected with the shaft sleeve 1032 through a bearing fit, and when the connector drives the hair removal component to move along a preset trajectory, the hair removal component will not shake.

Further, in some embodiments, the shell 20 is provided with a holding groove for holding the hair removal component 10. When the shape of the hair removal component 10 is irregular and it is difficult to rotate in the holding groove, it is necessary to push the hair removal component 10 out of the holding groove for rotation. In the embodiment, referring to FIG. 18, a metal threaded rod 321 is connected to the second side of the hair removal component 10, and the output shaft 2051 of the servo motor 205 is fixedly connected with a metal threaded sleeve 32 adapted to the threaded rod 321. The second side of the hair removal component 10 is also fixedly connected with an electromagnet 322. The output shaft 2051 of the servo motor 205 can drive the threaded sleeve 32 to rotate, and then the hair removal component 10 is pushed up and out through the threaded rod 321. When the hair removal component 10 is pushed out, the electromagnet 322 is energized, and the electromagnet 322 attracts the threaded sleeve 32 and the threaded rod 321 into a whole. When the servo motor 205 drives the threaded sleeve 32 to rotate again, the hair removal component 10 can be driven to rotate synchronously. When it is necessary to store the hair removal component 10 in the holding groove, the electromagnet 322 is de-energized, and when the servo motor 205 drives the threaded sleeve 32 to rotate again, the hair removal component 10 is pushed down for storage through the threaded rod 321.

Specifically, the circuit board is electrically connected with a speed gear adjustment component 203 for adjusting the driving component; the speed gear adjustment component 203 is connected with a speed gear adjustment button 206, and different speeds can be switched by the speed gear adjustment button 206, so that different speeds can apply to different hair removal situations, which greatly increases the application scenarios and improves the user experience. In a specific embodiment, three speed gears can be set, and the speed of the motor is controlled to gradually change from slow to fast through three different gears.

Specifically, a sealing component is connected between the output shaft 2051 of the servo motor 205 and the shell 20. The sealing component can prevent liquids such as water from entering the inside of the shell 20, which avoids short circuit or corrosion of electronic elements and prolongs the service life of electronic elements. In a specific embodiment, the sealing component can be a silicone ring.

Figure 10:
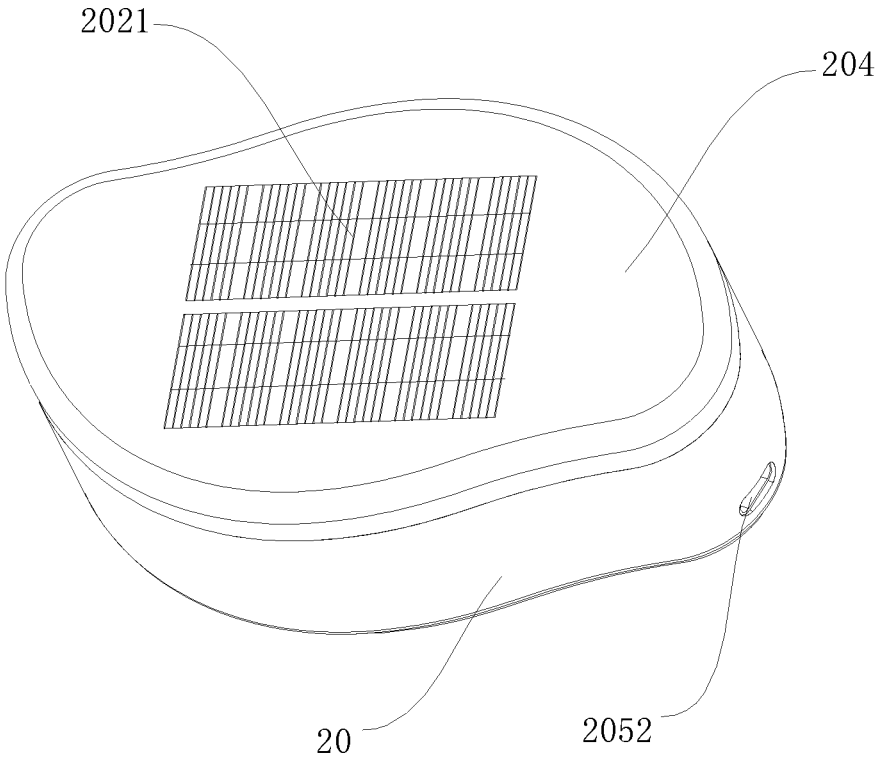
FIG. 10 is a structural diagram of the hair removal device in another embodiment of the present disclosure.

Further, referring to FIG. 10, the outer side of the shell 20 is provided with a PV (Photovoltaic) cell panel 2021 electrically connected with the circuit board, and the PV cell panel 2021 is used for absorbing solar energy and storing energy in the energy storage component 202; the hair removal equipment of the product is designed with various charging modes, and charging with the PV cell panel 2021 is beneficial to energy saving. It can be understood that the PV cell panel 2021 absorbs energy in two ways: optical energy-thermal energy-electric energy conversion and direct optical energy-electric energy conversion.

Further, the circuit board is electrically connected with a charging component, and the charging component includes a charging port 2052. The charging port 2052 runs through the shell 20, and is provided with at least one of MiniUSB interface, MicroUSB interface, Type-c interface or Lightning interface; the charging port 2052 can be provided with multiple interfaces, which are beneficial to application in various charging environments and improves the user experience. In the embodiment, the charging port 2052 is provided with a silicone waterproof plug. The silicone waterproof plug can prevent liquids such as water from entering the inside of the shell 20, which avoids short circuit or corrosion of electronic elements and prolongs the service life of electronic elements.

The hair removal device of the present disclosure comprises a shell 20 and a hair removal component 10 connected to at least one side of the shell 20. The hair removal component 10 is provided with a hair removal surface 101 on the side facing away from the shell 20. The hair removal surface 101 is provided with several pattern groups 1101, which are used for rubbing against the skin when the hair removal component 10 comes into contact with the skin so as to remove hair and dead skin on the skin surface. The hair removal device is ingenious in structural design and convenient to operate. When the hair removal surface 101 comes into contact with the skin, the main annular convex pattern touches the skin and rotates gently, and in the process of rotating and rubbing against the skin, the hair removal surface 101 grabs and pulls out or rubs off the hair on the skin surface and removes dead skin. Due to the annular structure of the main annular convex pattern, the adoption of the rotation and rubbing mode can reduce skin irritation, improve hair removal efficiency, remove hair from skin painlessly, and achieve the effect of smooth skin.

The above mentioned is only the specific embodiment of the present disclosure, but the protection scope of the present disclosure is not limited to this. Any technician familiar with the technical field can easily think of changes or substitutions within the technical scope disclosed by the present disclosure, which shall be covered by the protection scope of the present disclosure. Therefore, the protection scope of the present disclosure shall be based on the protection scope of the claims.

What is claimed is:

1. A hair removal device, characterized in that it comprises a shell and a hair removal component connected to at least one side of the shell, wherein a hair removal surface is arranged on a first side of the hair removal component facing away from the shell, a plurality of pattern groups are arranged on the hair removal surface, the plurality of pattern groups comprise at least one main annular convex pattern, and the at least one main annular convex pattern is used to remove hair and dead skin from the surface of skin by rubbing against the skin when the hair removal surface is in contact with the skin;

a hollow cavity is formed in the shell, and a driving component for driving the hair removal component to rotate and a circuit board electrically connected with the driving component are arranged in the cavity; the circuit board is electrically connected with an energy storage component for power supply;

the driving component comprises a servo motor, an output shaft of the servo motor is in eccentric rotation connection with the hair removal component through an eccentric shaft, a limiting component is connected between the hair removal component and the shell, and the limiting component is used to ensure that the hair removal component moves along a preset track when the servo motor drives the hair removal component to rotate;

the hair removal component comprises a first side and a second side, the hair removal surface being the first side;

a metal threaded rod is connected to the second side of the hair removal component, and the output shaft of the servo motor is fixedly connected with a metal threaded sleeve adapted to the metal threaded rod;

the second side of the hair removal component is fixedly connected with an electromagnet;

the output shaft of the servo motor is configured to rotate the threaded sleeve, so that the hair removal component is pushed up and out through the threaded rod;

when the hair removal component is pushed out, the electromagnet is energized, and the electromagnet attracts the threaded sleeve and the threaded rod;

when the servo motor rotates the threaded sleeve, the hair removal component is configured to rotate synchronously.

2. The hair removal device according to claim 1, characterized in that each of the plurality of pattern groups comprises two of the at least one main annular convex pattern, a first of the at least one main annular convex pattern having a relatively small inner diameter located inside a second of the at least one main annular convex pattern having a relatively large inner diameter.

3. The hair removal device according to claim 2, characterized in that each of the at least one main annular convex pattern is in a ring shape.

4. The hair removal device according to claim 3, characterized in that each of the at least one main annular convex pattern in one of the plurality of pattern groups is concentric rings.

5. The hair removal device according to claim 1, characterized in that one edge of an end of each of the at least one main annular convex pattern away from the hair removal surface is provided with a vertical surface structure, an inclined surface structure or a cambered surface structure.

6. The hair removal device according to claim 5, characterized in that the cross section of each of the at least one main annular convex pattern is in arc, square, trapezoidal or triangular shape.

7. The hair removal device according to claim 1, characterized in that the height of each of the at least one main annular convex pattern is 5-105 μm.

8. The hair removal device according to claim 1, characterized in that the hair removal component is made of crystal or glass, and the hair removal surface is of a planar or cambered surface structure.

9. The hair removal device according to claim 1, characterized in that the hair removal surface is smooth.

10. The hair removal device according to claim 1, characterized in that the plurality of the pattern groups are arranged in an array on the hair removal surface.

11. The hair removal device according to claim 1, characterized in that the hair removal surface is further provided with auxiliary annular convex patterns between two adjacent pattern groups of the plurality of pattern groups.

12. The hair removal device according to claim 11, characterized in that the auxiliary annular convex patterns are in annular shape and 5-105 μm high.

13. The hair removal device according to claim 1, characterized in that a peripheral shape of the shell is in arc or square shape, and a peripheral shape of the hair removal component is in arc or polygonal shape.

14. The hair removal device according to claim 1, characterized in that a side of the shell away from the hair removal component is provided with an arc groove or an arc-shaped protrusion or a handle.

15. The hair removal device according to claim 1, characterized in that a PV cell panel electrically connected to the circuit board is arranged on the outside of the shell, and the PV cell panel is used to absorb solar energy and store it in the energy storage component.

16. The hair removal device according to claim 1, characterized in that the circuit board is electrically connected with a charging component, the charging component comprises a charging port, the charging port penetrates the shell, and the charging port comprises a Mini USB interface, a Micro USB interface, a Type-c interface or a Lightning interface.

* * * * *